US007741234B2

(12) United States Patent
Smith et al.

(10) Patent No.: US 7,741,234 B2
(45) Date of Patent: Jun. 22, 2010

(54) EMBOSSED FIBROUS STRUCTURE PRODUCT WITH ENHANCED ABSORBENCY

(75) Inventors: Dana Jacqueline Smith, Fairfield, OH (US); LaRhonda Rachell Preston, Cincinnati, OH (US); Kevin Mitchell Wiwi, West Chester, OH (US); Ward William Ostendorf, West Chester, OH (US); Paul Dennis Trokhan, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 491 days.

(21) Appl. No.: 11/709,498

(22) Filed: Feb. 22, 2007

(65) Prior Publication Data

US 2007/0264896 A1 Nov. 15, 2007

Related U.S. Application Data

(60) Provisional application No. 60/799,563, filed on May 11, 2006.

(51) Int. Cl.
*B32B 5/26* (2006.01)

(52) U.S. Cl. ..... 442/381; 442/412; 442/413; 428/156; 428/170; 428/219

(58) Field of Classification Search ..... 442/413, 442/412, 381; 428/156, 170, 219
See application file for complete search history.

(56) References Cited

U.S. PATENT DOCUMENTS 3,994,771 A 11/1976 Morgan, Jr. et al.
4,300,981 A 11/1981 Carstens
H1672 H * 8/1997 Hermans et al. ..... 162/148
6,287,422 B1 * 9/2001 Harper et al. ..... 162/149

FOREIGN PATENT DOCUMENTS

JP 08291494 A 11/1996
WO WO 97/04956 2/1997
WO WO 2006/133389 A2 12/2006

OTHER PUBLICATIONS

International Search Report Dated Nov. 7, 2007.

* cited by examiner

*Primary Examiner*—Norca L Torres-Velazquez
(74) *Attorney, Agent, or Firm*—Betty J. Zea

(57) ABSTRACT

A fibrous structure product comprising one or more plies of fibrous structure; a basis weight from about 10 lbs/3000 $ft^2$ to about 50 lbs/3000 $ft^2$; from 16% to about 40% of hardwood fibers, in one embodiment eucalyptus fibers, wherein the starting hardwood fibers have a Runkel Ratio of from 4.5 to about 15 and a fiber count of from about 12 fibers/gram to about 35 fibers/gram; and a Residual Water Value from about 0.001 to about 0.18. In one embodiment the product comprises two or more plies of fibrous structure, a basis weight from about 25 lbs/3000 $ft^2$ to about 50 lbs/3000 $ft^2$ and from about 23% to about 40% of hardwood fibers. In another embodiment at least one of the piles of the fibrous structure product further comprises a plurality of embossments thereon comprising an embossment height of from about 600 μm to about 1,200 μm.

29 Claims, No Drawings

EMBOSSED FIBROUS STRUCTURE PRODUCT WITH ENHANCED ABSORBENCY

CROSS-REFERENCE TO RELATED APPLICATION

This application claims the benefit of provisional application Ser. No. 60/779,563, Ser. No. 60/799,563, filed May 11, 2006.

FIELD OF THE INVENTION

The present invention relates to fibrous structure products, having at least one ply, having enhanced absorbent capacity.

BACKGROUND OF THE INVENTION

Absorbency is an important attribute in consumer paper products such as bathroom tissue, towels, and napkins. This attribute is strongly influenced by the sheet structure of a paper product. Further, the types of fiber employed in the sheet are important factors in determining the absorbency and strength of products made from such fibers.

It is well known in the art that cellulosic fibers vary in their properties such as fiber length, fiber cell wall rigidity, fiber coarseness, lumen size, etc. Short fibers, including fines, in some instances may be considered less desirable fibers in most fiber slurries. In the past, such fines comprised short portions of cellulosic material which do not appreciably contribute to softness. Further, such fines may be too small to remain on a wire former in the papermaking process, and often fall through the wire mesh of the wire former with the water when a paper slurry is applied on the twin wire former in the early stages of paper manufacture. Thus, such fines may be simply washed from the system, and may not contribute in any meaningful way to the final paper product. Further, these fines may comprise cellulosic particles that undesirably absorb a large amount of the treatment chemicals that are used in the headbox at the early stages of slurry formation. In fact, such fines may undesirably absorb process chemicals which otherwise could be applied to the longer fibers which in fact do become part of a paper product. In this way, fines may waste processing chemicals by carrying such chemicals out of the processing system.

Further, a process that is able to employ and retain short fibers and long fibers in a way that provides a paper product with improved absorbency while also providing desirable strength and softness, would be advantageous.

It has been discovered that short fibers at a particular level within the furnish, with particular rigidity and lumen diameter features, provide desirable absorbency attributes, without sacrificing other desirable strength and softness attributes. Through the selection of the appropriate level, cell wall rigidity, thickness, and shape of the shorter cellulose fibers, an improved paper structure is provided having improved water channeling and absorption effects.

SUMMARY OF THE INVENTION

In one embodiment the present invention relates to a fibrous structure product comprising: a) one or more plies of fibrous structure; b) a basis weight from about 10 lbs/3000 $ft^2$ to about 50 lbs/3000 $ft^2$; c) from 16% to about 40% of hardwood fibers, in one embodiment eucalyptus fibers, wherein the starting hardwood fibers have a Runkel Ratio of from 4.5 to about 15 and a fiber count of from about 7 fibers/gram to about 35 fibers/gram; and d) a Residual Water Value from about 0.001 to about 0.18. In one embodiment the product comprises two or more plies of fibrous structure, a basis weight from about 25 lbs/3000 $ft^2$ to about 50 lbs/3000 $ft^2$ and from about 23% to about 40% of hardwood fibers. In another embodiment at least one of the piles of the fibrous structure product further comprises a plurality of embossments thereon comprising an embossment height of from about 600 μm to about 1,200 μm.

DETAILED DESCRIPTION OF THE INVENTION

Definitions

As used herein, "paper product" refers to any formed, fibrous structure products, traditionally, but not necessarily, comprising cellulose fibers. In one embodiment, the paper products of the present invention include tissue-towel paper products.

A "tissue-towel paper product" refers to products comprising paper tissue or paper towel technology in general, including, but not limited to, conventional felt-pressed or conventional wet-pressed tissue paper, pattern densified tissue paper, starch substrates, and high bulk, uncompacted tissue paper. Non-limiting examples of tissue-towel paper products include toweling, facial tissue, bath tissue, table napkins, and the like.

"Ply" or "Plies", as used herein, means an individual fibrous structure or sheet of fibrous structure, optionally to be disposed in a substantially contiguous, face-to-face relationship with other plies, forming a multi-ply fibrous structure. It is also contemplated that a single fibrous structure can effectively form two "plies" or multiple "plies", for example, by being folded on itself. In one embodiment, the ply has an end use as a tissue-towel paper product. A ply may comprise one or more wet-laid layers, air-laid layers, and/or combinations thereof. If more than one layer is used, it is not necessary for each layer to be made from the same fibrous structure. The actual makeup of a tissue paper ply is generally determined by the desired benefits of the final tissue-towel paper product, as would be known to one of skill in the art. The fibrous structure may comprise one or more plies of non-woven materials in addition to the wet-laid and/or air-laid plies.

The term "fibrous structure", as used herein, means an arrangement of fibers produced in any papermaking machine known in the art to create a ply of paper. "Fiber" means an elongate particulate having an apparent length greatly exceeding its apparent width. More specifically, and as used herein, fiber refers to such fibers suitable for a papermaking process.

"Basis Weight", as used herein, is the weight per unit area of a sample reported in lbs/3000 $ft^2$ or $g/m^2$.

"Machine Direction" or "MD", as used herein, means the direction parallel to the flow of the fibrous structure through the papermaking machine and/or product manufacturing equipment.

"Cross Machine Direction" or "CD", as used herein, means the direction perpendicular to the machine direction in the same plane of the fibrous structure and/or fibrous structure product comprising the fibrous structure.

"Densified", as used herein, means that portion of a fibrous structure product that exhibits a greater density than another portion of the fibrous structure product.

"Non-densified", as used herein, means a portion of a fibrous structure product that exhibits a lesser density than another portion of the fibrous structure product.

"Bulk Density", as used herein, means the apparent density of an entire fibrous structure product rather than a discrete area thereof.

"Embossing", as used herein, refers to the process of deflecting a relatively small portion of a cellulosic fibrous structure normal to its plane and impacting the projected portion of the fibrous structure against a relatively hard surface to permanently disrupt the fiber to fiber bonds.

"Laminating" refers to the process of firmly uniting superimposed layers of paper with or without adhesive, to form a multi-ply sheet.

The numerical ranges, herein, for the "fiber count" represent the fibers in million per gram, for example, 7 fibers/gram actually represent 7 million fibers/gram and 13 fibers/gram, 15 fibers/gram, 25 fibers/gram, and 35 fibers/gram represent 13 million fibers/gram, 15 million fibers/gram, 25 million fibers/gram and 35 million fibers/gram, repectively.

Single or Multi-ply Fibrous Structure Product

The present invention is equally applicable to all types of consumer paper products such as paper towels, toilet tissue, facial tissue, napkins, and the like.

The fibrous structure product herein comprises hardwood fibers, such as eucalyptus, tropical hardwood, Acacias, etc., and in another embodiment eucalyptus fibers, wherein the starting hardwood fibers (as measured pre-papermaking) have a Runkel Ratio of from about 4.5 to about 15 and a fiber count of from about 7 to about 35 fibers/gram.

The Runkel Ratio is a measure of the fiber morphology and the fiber collapse properties, and is measured by the following formula:

$$\text{Runkel Ratio} = \frac{(2t)}{\text{Lumen Diameter}}$$

wherein t is equal to the fiber wall thickness.

In one embodiment the hardwood fibers used herein have a Runkel Ratio of about 4.5, 5.5, 6.5, 7, 7.5 to about 11, 12, 15, or any combination of these numbers to make ranges; in another embodiment from about 5.5 to about 12, and in yet another embodiment from about 6.5 to about 11.

The wall thickness and lumen diameter of the fibers may be determined by using methods known in the art including using a Kajaani FiberLab Fiber Analyzer commercially available from Metso Automation, Kajaani Finland.

In one embodiment the hardwood fibers used herein have a fiber count of from about 7 to about 35 fibers (in millions)/gram; in another embodiment from about 13 to about 30, and in yet another embodiment from about 15 to about 25.

In one embodiment the fibrous structure product herein comprises from about 16% to about 40%, or about 23% to about 40% of hardwood fibers, in another embodiment from about 18% to about 35%, in yet another embodiment from about 25% to about 33%, of hardwood fibers, by weight of the fibrous structure product. In one embodiment the hardwood fiber are eucalyptus fibers. In another embodiment the eucalyptus fibers have a fiber count from about 12 to about 35 fibers/gram (in millions); in another embodiment from about 13 to about 30, and in yet another embodiment from about 15 to about 25.

In one embodiment the fibrous structure product comprises either no or only a low level of Southern Softwood Kraft (SSK), in another embodiment from about 0.05% to about 10%, in another embodiment from about 0.1% to about 5%, in another embodiment is essentially free of SSK.

In one embodiment the cellulose fibers of the fibrous structure product comprise only NSK (Northern Softwood Kraft) and eucalyptus fibers.

In one embodiment the fibrous structure products comprise pulps derived from deciduous hardwood trees, and may be selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, Magnolia, Bagasse, Flax, Hemp, Kenaf, and combinations thereof. In another embodiment the hardwood fiber is selected from the group consisting of Eucalyptus, Aspen, Birch, Beech, Oak, Maple, Gum and combinations thereof; in another embodiment Eucalyptus.

In one embodiment, the fibrous structure product has a basis weight of greater than about 25 lbs/3000 $ft^2$, in another embodiment from about 25 lbs/3000 $ft^2$ to about 50 lbs/3000 $ft^2$. In another embodiment the basis weight is about 26 lbs/3000 $ft^2$ to about 40 lbs/3000 $ft^2$; and in yet another embodiment the basis weight is about 27 lbs/3000 $ft^2$ and about 37 lbs/3000 $ft^2$ as measured by the Basis Weight Method described herein.

In one embodiment the fibrous structure product has a Residual Water Value (RWV) of less than or equal to about 0.18, in another embodiment from about 0.001 to about 0.18; in another embodiment from about 0.015 to about 0.17, in another embodiment from about 0.02 to about 0.16, and in another embodiment from about 0.1 to about 0.16, as measured by the Residual Water Value Test Method as disclosed herein.

In one embodiment in addition to hardwood fibers, or specifically eucalyptus fibers, the present invention contemplates the use of a variety of paper making fibers, such as, natural fibers, synthetic fibers, as well as any other suitable fibers, starches, and combinations thereof. Paper making fibers useful in the present invention include cellulosic fibers commonly known as wood pulp fibers. Applicable wood pulps include chemical pulps, such as Kraft, sulfite and sulfate pulps, as well as mechanical pulps including, groundwood, thermomechanical pulp, chemically modified, and the like. Chemical pulps may be used in tissue towel embodiments since they are known to those of skill in the art to impart a superior tactical sense of softness to tissue sheets made therefrom. Pulps derived from deciduous trees (hardwood) and/or coniferous trees (softwood) can be utilized herein. Such hardwood and softwood fibers can be blended or deposited in layers to provide a stratified web. Exemplary layering embodiments and processes of layering are disclosed in U.S. Pat. Nos. 3,994,771 and 4,300,981. Additionally, fibers derived from wood pulp such as cotton linters, bagesse, and the like, can be used. Additionally, fibers derived from recycled paper, which may contain any of all of the categories as well as other non-fibrous materials such as fillers and adhesives used to manufacture the original paper product may be used in the present web. In addition, fibers and/or filaments made from polymers, specifically hydroxyl polymers, may be used in the present invention. Non-limiting examples of suitable hydroxyl polymers include polyvinyl alcohol, starch, starch derivatives, chitosan, chitosan derivatives, cellulose derivatives, gums, arabinans, galactans, and combinations thereof. Additionally, other synthetic fibers such as rayon, polyethylene, and polypropylene fibers can be used within the scope of the present invention. Further, such fibers may be latex bonded.

In one embodiment the paper is produced by forming a predominantly aqueous slurry comprising about 95% to about 99.9% water.

In one embodiment the non-aqueous component of the slurry, used to make the fibrous structure, comprises only eucalyptus and NSK. The aqueous slurry is to be pumped to the headbox of the papermaking process.

In addition to the limitations disclosed herein, the fibrous structure product may comprise any tissue-towel paper product known in the industry. Embodiment of these substrates may be made according U.S. Pat. No. 4,191,609 issued Mar. 4, 1980 to Trokhan; U.S. Pat. No. 4,300,981 issued to Carstens on Nov. 17, 1981; U.S. Pat. No. 4,191,609 issued to Trokhan on Mar. 4, 1980; U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,245,025 issued to Trokhan et al. on Sep. 14, 1993; U.S. Pat. No. 5,275,700 issued to Trokhan on Jan. 4, 1994; U.S. Pat. No. 5,328,565 issued to Rasch et al. on Jul. 12, 1994; U.S. Pat. No. 5,334,289 issued to Trokhan et al. on Aug. 2, 1994; U.S. Pat. No. 5,364,504 issued to Smurkowski et al. on Nov. 15, 1995; U.S. Pat. No. 5,527,428 issued to Trokhan et al. on Jun. 18, 1996; U.S. Pat. No. 5,556,509 issued to Trokhan et al. on Sep. 17, 1996; U.S. Pat. No. 5,628,876 issued to Ayers et al. on May 13, 1997; U.S. Pat. No. 5,629,052 issued to Trokhan et al. on May 13, 1997; U.S. Pat. No. 5,637,194 issued to Ampulski et al. on Jun. 10, 1997; U.S. Pat. No. 5,411,636 issued to Hermans et al. on May 2, 1995; EP 677612 published in the name of Wendt et al. on Oct. 18, 1995, and U.S. Patent Application 2004/0192136A1 published in the name of Gusky et al. on Sep. 30, 2004.

The tissue-towel substrates may be manufactured via a wet-laid making process where the resulting web is through-air-dried or conventionally dried. Optionally, the substrate may be foreshortened by creping or by wet microcontraction. Creping and/or wet microcontraction are disclosed in commonly assigned U.S. Pat. No. 6,048,938 issued to Neal et al. on Apr. 11, 2000; U.S. Pat. No. 5,942,085 issued to Neal et al. on Aug. 24, 1999; U.S. Pat. No. 5,865,950 issued to Vinson et al. on Feb. 2, 1999; U.S. Pat. No. 4,440,597 issued to Wells et al. on Apr. 3, 1984; U.S. Pat. No. 4,191,756 issued to Sawdai on May 4, 1980; and U.S. Pat. No. 6,187,138 issued to Neal et al. on Feb. 13, 2001.

Conventionally pressed tissue paper and methods for making such paper are known in the art, for example U.S. Pat. No. 6,547,928 issued to Barnholtz et al. on Apr. 15, 2003. Another suitable tissue paper is pattern densified tissue paper which is characterized by having a relatively high-bulk field of relatively low structure density, (which may be discrete and/or fully or partially interconnected) and an array of densified zones of relatively high structure density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field.

Processes for making pattern densified tissue webs are disclosed in U.S. Pat. No. 3,301,746, issued to Sanford, et al. on Jan. 31, 1967; U.S. Pat. No. 3,974,025, issued to Ayers on Aug. 10, 1976; U.S. Pat. No. 4,191,609, issued to on Mar. 4, 1980; and U.S. Pat. No. 4,637,859, issued to on Jan. 20, 1987; U.S. Pat. No. 3,301,746, issued to Sanford, et al. on Jan. 31, 1967; U.S. Pat. No. 3,821,068, issued to Salvucci, Jr. et al. on May 21, 1974; U.S. Pat. No. 3,974,025, issued to Ayers on Aug. 10, 1976; U.S. Pat. No. 3,573,164, issued to Friedberg, et al. on Mar. 30, 1971; U.S. Pat. No. 3,473,576, issued to Amneus on Oct. 21, 1969; U.S. Pat. No. 4,239,065, issued to Trokhan on Dec. 16, 1980; and U.S. Pat. No. 4,528,239, issued to Trokhan on Jul. 9, 1985; U.S. Pat. No. 4,529,480.

Uncompacted, non pattern-densified tissue paper structures are also contemplated within the scope of the present invention and are described in U.S. Pat. No. 3,812,000 issued to Joseph L. Salvucci, Jr. et al. on May 21, 1974; and U.S. Pat. No. 4,208,459, issued to Henry E. Becker, et al. on Jun. 17, 1980. Uncreped tissue paper as defined in the art is also contemplated. The techniques to produce uncreped tissue in this manner are taught in the prior art; for example, Wendt, et al. in European Patent Application 0 677 612A2, published Oct. 18, 1995; Hyland, et al. in European Patent Application 0 617 164 A1, published Sep. 28, 1994; and Farrington, et al. in U.S. Pat. No. 5,656,132 issued Aug. 12, 1997.

Uncreped tissue paper, in one embodiment, refers to tissue paper which is non-compressively dried, in one embodiment, by through air drying. The techniques to produce uncreped tissue in this manner are taught in the prior art; for example, Wendt, et al. in European Patent Application 0 677 612A2, published Oct. 18, 1995; Hyland, et al. in European Patent Application 0 617 164 A1, published Sep. 28, 1994; and Farrington, et al. in U.S. Pat. No. 5,656,132 published Aug. 12, 1997.

Other materials are also intended to be within the scope of the present invention as long as they do not interfere or counteract any advantage presented by the instant invention.

The substrate which comprises the fibrous structure of the present invention may be cellulosic, or a combination of both cellulose and non-cellulose. The substrate may be conventionally dried using one or more press felts or through-air dried. If the substrate which comprises the paper according to the present invention is conventionally dried, it may be conventionally dried using a felt which applies a pattern to the paper as taught by commonly assigned U.S. Pat. No. 5,556,509 issued Sep. 17, 1996 to Trokhan et al. and PCT Application WO 96/00812 published Jan. 11, 1996 in the name of Trokhan et al. The substrate which comprises the paper according to the present invention may also be through air dried. A suitable through air dried substrate may be made according to commonly assigned U.S. Pat. No. 4,191,609; U.S. Pat. No. 4,239,065, issued Dec. 16, 1980, Trokhan and U.S. Pat. No. 3,905,863, issued Sep. 16, 1075, Ayres. The '065 patent relates to a loop of fabric for use on a papermaking machine which comprises at least two sets of filaments which, in each set, are generally parallel to each other and which sets are relatively steeply angularly related to each other. This is conventionally orthogonal but it is not intended to thereby limit it. The filaments are so woven and complimentarily serpentinely configured in at least the Z-direction (the thickness of the fabric) to provide a first grouping or array of coplanar top-surface-plane crossovers of both sets of filaments; and a predetermined second grouping or array of sub-top-surface crossovers. The arrays are interspersed so that portions of the top-surface-plane crossovers define an array of wicker-basket-like cavities in the top surface of the fabric which cavities are disposed in staggered relation in both the machine direction (MD) and the cross-machine direction (CD), and so that each cavity spans at least one sub-top-surface crossover. The cavities are discretely perimetrically enclosed in the plan view by a picket-like-lineament comprising portions of a plurality of the top-surface plane crossovers. The loop of fabric may comprise heat set monofilaments of thermoplastic material; the top surfaces of the coplanar top-surface-plane crossovers may be monoplanar flat surfaces. Specific embodiments include satin weaves as well as hybrid weaves of five or greater sheds, and mesh counts of from about 10 by about 10 to about 120 to about 120 filaments per inch (4×4 to about 47×47 per centimeter); in another embodiment the range of mesh counts is from about 18 by about 16 to about 45 b about 38 filaments per inch (9×8 to about 18×15 per centimeter).

U.S. Pat. No. 3,905,863 relates to a low density, soft, bulky and absorbent paper sheet, this paper sheet exhibiting a diamond-shaped pattern in its surface after creping, said paper sheet being characterized by having a cross-directional stretch of from about 2% to about 6%. These sheets are produced, in one embodiment, generally in accordance with the teachings of U.S. Pat. No. 3,301,746 by forming an uncompacted paper web, supporting said uncompacted paper web on the back side of a monofilament, polymeric fiber, semi-twill imprinting fabric having about 20 to about 60 meshes per inch, said imprinting fabric having been formed from filaments having a diameter of from about 0.008 inches to about 0.025 inches, the back side of said fabric having had its knuckle imprint area increased in accordance with the teachings of U.S. Pat. No. 3,573,164, thermally pre-drying said uncompacted paper web to a fiber consistency of about 30 percent to about 98 percent, imprinting a dot-dash knuckle pattern with the back side of said semi-twill imprinting fabric such that the long axis of the dash impressions in said pattern is aligned parallel to the machine direction and the long axis of the dot impressions is aligned parallel to the cross-machine direction of the pre-dried uncompacted paper web, and final drying and creping the paper sheet so formed. In another embodiment, the back side of the monofilament, polymeric fiber, semi-twill imprinting fabric is prepared in accordance with the teachings of U.S. Pat. No. 3,573,164 by abrading the knuckle surfaces to increase the knuckle imprint area to between about 20 percent and about 50 percent of the total fabric surface area, as measured in the plane of the knuckles, as well as to polish the knuckle surfaces. In yet another embodiment of '863, the monofilament, polymeric fiber, semi-twill fabric is woven and heat treated so as to produce a dimensionally heat stable fabric having uniform knuckle heights and minimum free area on its back side prior to abrading the knuckle surfaces on the back side of the fabric.

TAD fabrics that may be useful in making the fibrous structure products herein include those sold under the trademark ProLux 003 from Albany International, having a 3(over)×2(under) machine direction weave pattern with a 2(over)×1(under)×1(over)×1(under) cross machine direction weave pattern, five-shed layer single layer fabric design, with long MD sheet side knuckles and uniform sheet side surface. Further specifications include about 17 to about 20 cm mesh, about 10 to about 14 cm count, about 0.77-0.90 mm caliper, about 2.3 to about 3.0 m/s air permeability (about 500 to about 650 cfm), and a fabric weight of about 530- to about 600 g/m2. Filament diameters may be from about 0.1 to about 0.6, in another embodiment from about 0.2 to about 0.5 mm.

The fibrous structure product according to the present invention may be made according to commonly assigned U.S. Pat. No. 4,528,239 issued Jul. 9, 1985 to Trokhan; U.S. Pat. No. 4,529,480 issued Jul. 16, 1985 to Trokhan; U.S. Pat. No. 5,275,700 issued Jan. 4, 1994 to Trokhan; U.S. Pat. No. 5,364,504 issued Nov. 15, 1985 to Smurkoski et al.; U.S. Pat. No. 5,527,428 issued Jun. 18, 1996 to Trokhan et al.; U.S. Pat. No. 5,609,725 issued Mar. 11, 1997 to Van Phan; U.S. Pat. No. 5,679,222 issued Oct. 21, 1997 to Rasch et al.; U.S. Pat. No. 5,709,775 issued Jan. 20, 1995 to Trokhan et al.; U.S. Pat. No. 5,795,440 issued Aug. 18, 1998 to Ampulski et al.; U.S. Pat. No. 5,900,122 issued May 4, 1999 to Huston; U.S. Pat. No. 5,906,710 issued May 25, 1999 to Trokhan; U.S. Pat. No. 5,935,381 issued Aug. 10, 1999 to Trokhan et al.; and U.S. Pat. No. 5,938,893 issued Aug. 17, 1999 to Trokhan et al.

In one embodiment the plies of the multi-ply fibrous structure may be the same substrate respectively or the plies may comprise different substrates combined to create desired consumer benefits. In one embodiment the fibrous structures comprise two plies of tissue substrate. In another embodiment the fibrous structure comprises a first ply, a second ply, and at least one inner ply.

In one embodiment of the present invention, the fibrous structure product has a plurality of embossments. In one embodiment the embossment pattern is applied only to one ply. In another embodiment the fibrous structure product is a two ply product wherein both plies comprise a plurality of embossments. In one embodiment the fibrous structure product comprises two or more plies of fibrous structure wherein at least one of the piles has a plurality of embossments thereon comprising an embossment height from about 600 μm to about 1,200 μm, in another embodiment from about 700 μm to about 1,100 μm, as measured by the Embossment Structure Height Measurement Method disclosed herein.

Suitable means of embossing include those disclosed in U.S. Pat. Nos. 3,323,983 issued to Palmer on Sep. 8, 1964; 5,468,323 issued to McNeil on Nov. 21, 1995; 5,693,406 issued to Wegele et al. on Dec. 2, 1997; 5,972,466 issued to Trokhan on Oct. 26, 1999; 6,030,690 issued to McNeil et al. on Feb. 29, 2000; and 6,086,715 issued to McNeil on July 11.

Suitable means of laminating the plies include but are not limited to those methods disclosed in commonly assigned U.S. Pat. Nos. 6,113,723 issued to McNeil et al. on Sep. 5, 2000; 6,086,715 issued to McNeil on Jul. 11, 2000; 5,972,466 issued to Trokhan on Oct. 26, 1999; 5,858,554 issued to Neal et al. on Jan. 12, 1999; 5,693,406 issued to Wegele et al. on Dec. 2, 1997; 5,468,323 issued to McNeil on Nov. 21, 1995; 5,294,475 issued to McNeil on Mar. 15, 1994.

The multi-ply fibrous structure product may be in roll form. When in roll form, the multi-ply fibrous structure product may be wound about a core or may be wound without a core.

Optional Ingredients

The fibrous structure product herein may optionally, in one embodiment, comprise one or more ingredients that may be added to the aqueous papermaking furnish or the embryonic web. These optional ingredients may be added to impart other desirable characteristics to the product or improve the papermaking process so long as they are compatible with the other components of the fibrous structure product and do not significantly and adversely affect the functional qualities of the present invention. The listing of optional chemical ingredients is intended to be merely exemplary in nature, and is not meant to limit the scope of the invention. Other materials may be included as well so long as they do not interfere or counteract the advantages of the present invention.

A cationic charge biasing species may be added to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. In one embodiment the cationic charge biasing species is alum. In addition charge biasing may be accomplished by use of relatively low molecular weight cationic synthetic polymer, in one embodiment having a molecular weight of no more than about 500,000 and in another embodiment no more than about 200,000, or even about 100,000. The charge densities of such low molecular weight cationic synthetic polymers are relatively high. These charge densities range from about 4 to about 8 equivalents of cationic nitrogen per kilogram of polymer. An exemplary material is Cypro 514®, a product of Cytec, Inc. of Stamford, Conn.

High surface area, high anionic charge microparticles for the purposes of improving formation, drainage, strength, and retention may also be included herein. See, for example, U.S. Pat. No. 5,221,435, issued to Smith on Jun. 22, 1993.

If permanent wet strength is desired, cationic wet strength resins may be optionally added to the papermaking furnish or to the embryonic web. From about 2 to about 50 lbs./ton of dry paper fibers of the cationic wet strength resin may be used, in another embodiment from about 5 to about 30 lbs./ton, and in another embodiment from about 10 to about 25 lbs./ton.

The cationic wet strength resins useful in this invention include without limitation cationic water soluble resins. These resins impart wet strength to paper sheets and are well known to the paper making art. These resins may impart either temporary or permanent wet strength to the sheet. Such resins include the following Hercules products. KYMENE® resins obtainable from Hercules Inc., Wilmington, Del. may be used, including KYMENE® 736 which is a polyethyleneimine (PEI) wet strength polymer. It is believed that the PEI imparts wet strength by ionic bonding with the pulps carboxyl sites. KYMENE® 557LX is polyamide epichlorohydrin (PAE) wet strength polymer. It is believed that the PAE contains cationic sites that lead to resin retention by forming an ionic bond with the carboxyl sites on the pulp. The polymer contains 3-azetidinium groups which react to form covalent bonds with the pulps' carboxyl sites as well as crosslink with the polymer backbone. The product must undergo curing in the form of heat or undergo natural aging for the reaction of the azentidinium group. KYMENE® 450 is a base activated epoxide polyamide epichlorohydrin polymer. It is theorized that like 557LX the resin attaches itself ionically to the pulps' carboxyl sites. The epoxide group is much more reactive than the azentidinium group. The epoxide group reacts with both the hydroxyl and carboxyl sites on the pulp, thereby giving higher wet strengths. The epoxide group can also crosslink to the polymer backbone. KYMENE® 2064 is also a base activated epoxide polyamide epichlorohydrin polymer. It is theorized that KYMENE® 2064 imparts its wet strength by the same mechanism as KYMENE® 450. KYMENE® 2064 differs in that the polymer backbond contains more epoxide functional groups than does KYMENE® 450. Both KYMENE® 450 and KYMENE® 2064 require curing in the form of heat or natural aging to fully react all the epoxide groups, however, due to the reactiveness of the epoxide group, the majority of the groups (80-90%) react and impart wet strength off the paper machine. Mixtures of the foregoing may be used. Other suitable types of such resins include urea-formaldehyde resins, melamine formaldehyde resins, polyamide-epichlorohydrin resins, polyethyleneimine resins, polyacrylamide resins, dialdehyde starches, and mixtures thereof. Other suitable types of such resins are described in U.S. Pat. No. 3,700,623, issued Oct. 24, 1972; U.S. Pat. No. 3,772,076, issued Nov. 13, 1973; U.S. Pat. No. 4,557,801, issued Dec. 10, 1985 and U.S. Pat. No. 4,391,878, issued Jul. 5, 1983.

In one embodiment, the cationic wet strength resin may be added at any point in the processes, where it will come in contact with the paper fibers prior to forming the wet web. For example, the cationic wet strength resin may be added to the thick or the thin stock directly, in may be added at the tray, the fan pump, the head box, the machine chest, the dump chest or the pulper. In another embodiment the cationic wet strength resin is added to the thick stock. It should be noted, however, that the optimal addition point may very from paper machine to paper machine and from grade of paper to grade of paper.

Many paper products must have limited strength when wet because of the need to dispose of them through toilets into septic or sewer systems. If wet strength is imparted to these products, in one embodiment fugitive wet strength is present, characterized by a decay of part or all of the initial strength upon standing in presence of water. If fugitive wet strength is desired, the binder materials can be chosen from the group consisting of dialdehyde starch or other resins with aldehyde functionality such as Co-Bond 1000® offered by National Starch and Chemical Company of Scarborough, Me.; Parez 750® offered by Cytec of Stamford, Conn.; and the resin described in U.S. Pat. No. 4,981,557, issued on Jan. 1, 1991, to Bjorkquist, and other such resins having the decay properties described above as may be known to the art.

If enhanced absorbency is needed, surfactants may be used to treat the paper webs of the present invention. The level of surfactant, if used, in one embodiment, from about 0.01% to about 2.0% by weight, based on the dry fiber weight of the tissue web. In one embodiment the surfactants have alkyl chains with eight or more carbon atoms. Exemplary anionic surfactants include linear alkyl sulfonates and alkylbenzene sulfonates. Exemplary nonionic surfactants include alkylglycosides including alkylglycoside esters such as Crodesta SL40® which is available from Croda, Inc. (New York, N.Y.); alkylglycoside ethers as described in U.S. Pat. No. 4,011,389, issued to Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.). Alternatively, cationic softener active ingredients with a high degree of unsaturated (mono and/or poly) and/or branched chain alkyl groups can greatly enhance absorbency.

In addition, chemical softening agents may be used. In one embodiment the chemical softening agents comprise quaternary ammonium compounds including, but not limited to, the well-known dialkyldimethylammonium salts (e.g., ditallowdimethylammonium chloride, ditallowdimethylammonium methyl sulfate ("DTDMAMS"), di(hydrogenated tallow)dimethyl ammonium chloride, etc.). In another embodiment variants of these softening agents include mono or diester variations of the before mentioned dialkyldimethylammonium salts and ester quaternaries made from the reaction of fatty acid and either methyl diethanol amine and/or triethanol amine, followed by quaternization with methyl chloride or dimethyl sulfate.

Another class of papermaking-added chemical softening agents comprises organo-reactive polydimethyl siloxane ingredients, including the amino functional polydimethyl siloxane. The fibrous structure product of the present invention may further comprise a diorganopolysiloxane-based polymer. These diorganopolysiloxane-based polymers useful in the present invention span a large range of viscosities; from about 10 to about 10,000,000 centistokes (cSt) at 25° C. Some diorganopolysiloxane-based polymers useful in this invention exhibit viscosities greater than 10,000,000 centistokes (cSt) at 25° C. and therefore are characterized by manufacturer specific penetration testing. Examples of this characterization are GE silicone materials SE 30 and SE 63 with penetration specifications of 500-1500 and 250-600 (tenths of a millimeter) respectively.

Among the diorganopolysiloxane polymers of the present invention are diorganopolysiloxane polymers comprising repeating units, where said units correspond to the formula $(R_2SiO)_n$, where R is a monovalent radical containing from 1 to 6 carbon atoms, in one embodiment selected from the group consisting of methyl, ethyl, propyl, isopropyl, butyl, isobutyl, t-butyl, amyl, hexyl, vinyl, allyl, cyclohexyl, amino alkyl, phenyl, fluoroalkyl and mixtures thereof. The diorganopoylsiloxane polymers which may be employed in the present invention may contain one or more of these radicals as substituents on the siloxane polymer backbone. The diorganopolysiloxane polymers may be terminated by triorganosilyl groups of the formula ($R'_3Si$) where R' is a monovalent radical selected from the group consisting of radicals containing from 1-6 carbon atoms, hydroxyl groups, alkoxyl groups, and mixtures thereof. In one embodiment the silicone polymer is a higher viscosity polymers, e.g., poly(dimethylsiloxane), herein referred to as PDMS or silicone gum, having a viscosity of at least 100,000 cSt.

Silicone gums, optionally useful herein, corresponds to the formula:

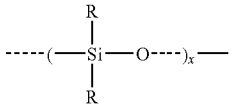

where R is a methyl group.

Fluid diorganopolysiloxane polymers that are commercially available include SE 30 silicone gum and SF96 silicone fluid available from the General Electric Company. Similar materials can also be obtained from Dow Corning and from Wacker Silicones.

An additional fluid diorganosiloxane-based polymer optionally for use in the present invention is a dimethicone copolyol. The dimethicone copolyol can be further characterized as polyalkylene oxide modified polydimethysiloxanes, such as manufactured by the Witco Corporation under the trade name Silwet. Similar materials can be obtained from Dow Corning, Wacker Silicones and Goldschmidt Chemical Corporation as well as other silicone manufacturers. Silicones useful herein are further disclosed in U.S. Pat. Nos. 5,059,282; 5,164,046; 5,246,545; 5,246,546; 5,552,345; 6,238,682; 5,716,692.

The chemical softening agents are generally useful at a level of from about 0.01% to about 15%, in another embodiment from about 0.1% to about 3%, and in another embodiment from about 0.2% to about 2% by weight of the fibrous structure product.

Filler materials may also be incorporated into the fibrous substrate products of the present invention. U.S. Pat. No. 5,611,890, issued to Vinson et al. on Mar. 18, 1997, discloses filled tissue-towel paper products that are acceptable as substrates for the present invention.

In addition antibacterial agents, coloring agents such as print elements, perfumes, dyes, and mixtures thereof, may be included in the fibrous structure product of the present invention.

Test Methods

The following describe the test methods utilized herein to determine the values consistent with those presented herein.

Basis Weight Method

Basis weight is measured by conditioning a sample for 24 hours at:

Temperature: 23° C.±1° C. (73° F.±2° F.)

Relative Humidity: 50%±2% and then preparing one or more samples of a certain area (3000 $ft^2$ or $m^2$) and weighing the sample(s) of a fibrous structure according to the present invention and/or a fibrous structure product comprising such fibrous structure on a top loading balance with a minimum resolution of 0.01 g. The balance is protected from air drafts and other disturbances using a draft shield. Weights are recorded when the readings on the balance become constant. The average weight (lbs or g) is calculated and the average area of the samples (3000 $ft^2$ or $m^2$). The basis weight (lbs/3000 $ft^2$ or g/$m^2$) is calculated by dividing the average weight (lbs or g) by the average area of the samples (3000 $ft^2$ or $m^2$). This method is herein referred to as the Basis Weight Method.

Residual Water Value (RWV) Test Method

This method measures the amount of distilled water absorbed by a paper product. In general a finite amount of distilled water is deposited to a standard surface. A paper towel is then placed over the water for a given amount of time. After the elapsed time the towel is removed and the amount of water left behind and amount of water absorbed are calculated.

The temperature and humidity are controlled within the following limits:

Temperature: 23° C.±1° C. (73° F.±2° F.)

Relative humidity: 50±2%

The following equipment is used in this test method. A top loading balance is used with sensitivity: ±0.01 grams or better having the capacity of grams minimum. A pipette is used having a capacity of 5 mL and a Sensitivity±1 mL. A Formica™ Tile 6 in×7 in is used. A stop watch or digital timer capable of measuring time in seconds to the nearest 0.1 seconds is also used.

Sample and Solution Preparation

For this test method, distilled water is used, controlled to a temperature of 23° C.±1° C. (730° F.±2° F.). For this method, a useable unit is described as one finished product unit regardless of the number of plies. Condition the rolls or useable units of products, with wrapper or packaging materials removed in a room conditioned at 50+2% relative humidity, 23° C.±1° C. (73°±2° F.) for a minimum of two hours. Do not test useable units with defects such as wrinkles, tears, holes etc.

Paper Samples

Remove and discard at least the four outermost useable units from the roll. For testing remove useable units from each roll of product submitted as indicated below. For Paper Towel products, select five (5) usable units from the roll. For Paper Napkins that are folded, cut and stacked, select five (5) useable units from the sample stack submitted for testing. For all napkins, either double or triple folded, unfold the useable units to their largest square state. One-ply napkins will have one 1-ply layer; 2-ply napkins will have one 2-ply layer. With 2-ply napkins, the plies may be either embossed (just pressed) together, or embossed and laminated (pressed and glued) together. Care must be taken when unfolding 2-ply useable units to keep the plies together. If the unfolded useable unit dimensions exceed 279 mm (11 inches) in either direction, cut the useable unit down to 279 mm (11 inches). Record the original useable unit size if over 279 mm. (11 inches). If the unfolded useable unit dimensions are less than 279 mm (11 inches) in either direction, record the useable unit dimensions Place the Formica Tile (standard surface) in the center of the cleaned balance surface. Wipe the Formica Tile to ensure that it is dry and free of any debris. Tare the balance to get a zero reading. Slowly dispense 2.5 mL of distilled water onto the center of the standard surface using the pipette. Record the weight of the water to the nearest 0.001 g. Drop 1 useable unit of the paper towel onto the spot of water with the outside ply down. Immediately start the stop watch. The sample should be dropped on the spot such that the spot is in the center of the sample once it is dropped. Allow the paper towel to absorb the distilled water for 30 seconds after hitting the stop watch. Remove the paper from the spot after the 30 seconds has elapsed. The towel must be removed when the stop watch reads 30 seconds±0.1 secs. The paper towel should be removed using a quick vertical motion. Record the weight of the remaining water on the surface to the nearest 0.001 g.

Calculations $$RWV\ \text{Average}(g) = \frac{\sum_{n=1}^{5}(\text{Amount of } H_2O \text{ Remaining}(g))}{n}.$$

n=the number of replicates which for this method is 5.

Record the RWV to the nearest 0.001 g.

Embossment Structure Height Measurement Method

The geometric characteristics of the embossment structure of the present invention are measured using an Optical 3D Measuring System MikroCAD compact for paper measurement instrument (the "GFM MikroCAD optical profiler instrument") and ODSCAD Version 4.14 software available from GFMesstechnik GmbH, Warthestraβe E21, D14513 Teltow, Berlin, Germany. The GFM MikroCAD optical profiler instrument includes a compact optical measuring sensor based on digital micro-mirror projection, consisting of the following components:

A) A DMD projector with 1024×768 direct digital controlled micro-mirrors.

B) CCD camera with high resolution (1280×1024 pixels).

C) Projection optics adapted to a measuring area of at least 160×120 mm.

D) Recording optics adapted to a measuring area of at least 160×120 mm;

E) Schott KL1500 LCD cold light source.

F) A table stand consisting of a motorized telescoping mounting pillar and a hard stone plate;

G) Measuring, control and evaluation computer.

H) Measuring, control and evaluation software ODSCAD 4.14.

I) Adjusting probes for lateral (XY) and vertical (Z) calibration.

The GFM MikroCAD optical profiler system measures the height of a sample using the digital micro-mirror pattern projection technique. The result of the analysis is a map of surface height (Z) versus XY displacement. The system should provide a field of view of 160×120 mm with an XY resolution of 21 μm. The height resolution is set to between 0.10 μm and 1.00 μm. The height range is 64,000 times the resolution. To measure a fibrous structure sample, the following steps are utilized:

1. Turn on the cold-light source. The settings on the cold-light source are set to provide a reading of at least 2,800 k on the display.
2. Turn on the computer, monitor, and printer, and open the software.
3. Verify calibration accuracy by following the manufacturers instructions.
4. Select "Start Measurement" icon from the ODSCAD task bar and then click the "Live Image" button.
5. Obtain a fibrous structure sample that is larger than the equipment field of view and conditioned at a temperature of 73° F.±2° F. (about 23° C.±1° C.) and a relative humidity of 50%+2% for 2 hours. Place the sample under the projection head. Position the projection head to be normal to the sample surface.
6. Adjust the distance between the sample and the projection head for best focus in the following manner. Turn on the "Show Cross" button. A blue cross should appear on the screen. Click the "Pattern" button repeatedly to project one of the several focusing patterns to aid in achieving the best focus. Select a pattern with a cross hair such as the one with the square. Adjust the focus control until the cross hair is aligned with the blue "cross" on the screen.
7. Adjust image brightness by increasing or decreasing the intensity of the cold light source or by altering the camera gains setting on the screen. When the illumination is optimum, the red circle at the bottom of the screen labeled "I.O." will turn green.
8. Select "Standard" measurement type.
9. Click on the "Measure" button. The sample should remain stationary during the data acquisition.
10. To move the data into the analysis portion of the software, click on the clipboard/man icon.
11. Click on the icon "Draw Cutting Lines." On the captured image, "draw" a cutting line that extends from the center of a negative embossment through the centers of at least six negative embossments, ending on the center of a final negative embossment. Click on the icon "Show Sectional Line Diagram." Move the cross-hairs to a representative low point on one of the left hand negative embossments and click the mouse. Then move the cross-hairs to a representative low point on one of the right hand negative embossments and click the mouse. Click on the "Align" button by marked point's icon. The Sectional Line Diagram is now adjusted to the zero reference line.
12. Measurement of Emboss Height, "a". Using the Sectional Line Diagram described in step 11, click the mouse on a representative low point of a negative emboss, followed by clicking the mouse on a representative point on the nearby upper surface of the sample. Click the "Vertical" distance icon. Record the distance measurement. Repeat the previous steps until the depth of six negative embossments have been measured. Take the average of all recorded numbers and report in mm, or μm, as desired. This number is the embossment height.

All measurements referred to herein are made at 23±1° C. and 50% relative humidity, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fibrous structure product comprising:

a) two or more plies of through air dried fibrous structure;

b) a basis weight from about 10 lbs/3000 $ft^2$ to about 50 lbs/3000 $ft^2$;

c) from 16% to about 40% of hardwood fibers by weight of the fibrous structure product;

d) a Residual Water Value from about 0.001 to about 0.18; wherein the starting hardwood fibers have a Runkel Ratio of from 4.5 to about 15 and a fiber count of from about 7 fibers/gram to about 35 fibers/gram.

2. The product of claim 1 wherein the plies comprises a fibrous structure selected from the group consisting of: creped or uncreped through-air-dried fibrous structure, differential density fibrous structure, wet laid fibrous structure, air laid fibrous structure, and mixtures thereof.

3. The product of claim 2 wherein the ply is a creped through-air-dried fibrous structure.

4. The product of claim 1 wherein the Residual Water Value is from about 0.015 to about 0.17.

5. The product of claim 4 wherein the Residual Water Value is from about 0.1 to about 0.16.

6. The product of claim 1 comprising from about 18% to about 35% of hardwood fibers.

7. The product of claim 6 wherein the hardwood comprises eucalyptus at a level of from about 25% to about 33%.

8. The product of claim 6 wherein the basis weight is from about 20 lbs/3000 $ft^2$ to about 40 lbs/3000 $ft^2$.

9. The product of claim 8 wherein the basis weight is from about 25 lbs/3000 $ft^2$ to about 33 lbs/3000 $ft^2$.

10. The product of claim 1 wherein the Runkel Ratio is from about 5.5 to about 12.

11. The product of claim 10 wherein the Runkel Ratio is from about 6.5 to about 11.

12. The product of claim 3 wherein the fiber count is from about 13 fibers/gram to about 30 fibers/gram.

13. The product of claim 12 wherein the fiber count is from about 15 fiber/gram to about 25 fibers/gram.

14. The product of claim 2 comprising a basis weight from about 25 lbs/3000 $ft^2$ to about 50 lbs/3000 $ft^2$ and from about 23% to about 40% of hardwood fibers.

15. The product of claim 14 wherein the Residual Water Value is from about 0.015 to about 0.17.

16. The product of claim 15 wherein the Residual Water Value is from about 0.1 to about 0.16.

17. The product of claim 14 wherein the Runkel Ratio is from about 5.5 to about 12.

18. The product of claim 17 wherein the Runkel Ratio is from about 6.5 to about 11.

19. The product of claim 14 where the hardwood fiber count is from about 13 fibers/gram to about 30 fibers/gram.

20. The product of claim 19 where the fiber count is from about 15 fibers/gram to about 25 fibers/gram.

21. The product of claim 14 comprising from about 26% to about 35% of eucalyptus hardwood fibers.

22. The product of claim 14 comprising from about 0.05% to about 10% of Southern Softwood Kraft fibers.

23. The product of claim 14 wherein the ply comprises a creped through-air dried tissue paper.

24. The product of claim 23 wherein at least one of the piles comprises a plurality of embossments thereon comprising an embossment height of from about 600 μm to about 1,200 μm.

25. The product of claim 14 further comprising a chemical softening agent at a level of from about 0.01% to about 15% wherein the chemical softening agent is selected from the group consisting of quaternary ammonium compounds, organo-reactive polydimethyl siloxane compounds, and mixtures thereof.

26. The product of claim 25 wherein the chemical softening agent is selected from the group consisting of dialkyldimethylammonium salts, ditallowedimethylammonium chloride, ditallowedimethylammonium methyl sulfate, di(hydrogenated tallow) dimethyl ammonium chloride, mono or diester variations of the dialkyldimethylammonium, and mixtures thereof.

27. The product of claim 2 wherein the fibrous structure is a creped through-air dried structure and comprises discrete lower density regions and interconnected densified zones.

28. The product of claim 2 wherein the fibrous structure is a creped through-air dried structure and comprises interconnected lower density regions and discrete densified zones.

29. The product of claim 1 wherein at least one of the piles comprises a plurality of embossments thereon comprising an embossment height of from about 600 μm to about 1,200 μm.

* * * * *

UNITED STATES PATENT AND TRADEMARK OFFICE

CERTIFICATE OF CORRECTION

PATENT NO. : 7,741,234 B2
APPLICATION NO. : 11/709498
DATED : June 22, 2010
INVENTOR(S) : Dana Jacqueline Smith et al.

It is certified that error appears in the above-identified patent and that said Letters Patent is hereby corrected as shown below:

In Col. 1, line 8, the Serial Number "60/779,563, Ser. No. 60/799,563" should be Ser. No. 60/799,563

Signed and Sealed this

Twelfth Day of October, 2010

David J. Kappos

David J. Kappos
*Director of the United States Patent and Trademark Office*